US007143758B1

(12) United States Patent
Lambert

(10) Patent No.: US 7,143,758 B1
(45) Date of Patent: Dec. 5, 2006

(54) EXPEDITIOUS JOINT CUTTER FOR CONCRETE CURBING

(76) Inventor: William Stephen Lambert, 224 Rio Vista Ave., Jefferson, LA (US) 70121

( * ) Notice: Subject to any disclaimer, the term of this patent is extended or adjusted under 35 U.S.C. 154(b) by 485 days.

(21) Appl. No.: 10/431,248

(22) Filed: May 7, 2003

(51) Int. Cl.
*B28D 1/06* (2006.01)

(52) U.S. Cl. ..... 125/12; 125/16.03

(58) Field of Classification Search ..... 125/12, 125/16.01, 16.03, 38; 83/743; 30/280, 314; 451/162, 164, 344, 356, 439, 540, 557, 558
See application file for complete search history.

(56) References Cited

U.S. PATENT DOCUMENTS 216,663 A * 6/1879 Fagan ..... 83/743
256,601 A * 4/1882 Seeger ..... 83/743
311,501 A * 2/1885 Lucas ..... 83/743
4,213,364 A * 7/1980 Sahlin ..... 83/471.3
6,311,598 B1 * 11/2001 Osborne ..... 83/745

FOREIGN PATENT DOCUMENTS

DE 4126878 A1 * 2/1993

* cited by examiner

*Primary Examiner*—David B. Thomas

(57) ABSTRACT

A lever operated sawblade mounted on a slotted form ensemble for cutting green concrete construction joints to accommodate a specified curb cross-section profile while the access slot avails the sliding sawblade removal of concrete to create a void to accept insertion of pertinent expansion joint material.

9 Claims, 4 Drawing Sheets

EXPEDITIOUS JOINT CUTTER FOR CONCRETE CURBING

BACKGROUND OF THE INVENTION

1. Field of the Invention

The present invention relate to the cutting and finishing of expansion and construction joints in highway and street concrete curb construction. An expansion joint in concrete curbing is necessary to allow for linear expansion and contraction of the concrete, in order to prevent fragmentation and destruction of the curbing.

2. Related Art

Before the automatic, self-powered slip-form curbing machine, roadside curbing was formed and constructed by hand by skilled technicians. Expansion joints were formed by heading-up or terminating the curb and finishing an interior face of the joint. Then, adjacent that face, the expansion joint material was installed, and construction of the subsequent curb began against that face.

In the current highway and street industry, a compacted-concrete curbing is automatically auger-extruded from a self-propelled, laser-guided curb-paving machine. Such machines have revolutionized curb building except for one crucial aspect: cutting joints. Today, joints are either hand-built per above, or "paved-through" and then saw cut while semi-cured. Saw cutting is typically performed using a diamond blade, which is expensive, and leaves sharp edges that, absent trawled edging, is subject to edge chips.

To date, a master finisher, or concrete mechanic, is still required for constructing expansion joints. The freshly extruded, green concrete curbing must be temporarily destroyed for at least six inches on each side of the designated joint in order to construct the joint, and then rebuild the remainder of the temporarily destroyed curb with uncompacted concrete, thus diminishing cohesive integrity. The finisher must also be mindful that the shelf life of concrete begins expiring upon exiting the concrete plant. The integrity of consolidated, cohesive homogeneity through chemical reaction must be maintained and undisturbed throughout the restored cross-section of the joint until fully cured. The mix must be wet enough to be pliable, while at the same time, stiff enough to maintain the prescribed cross-section profile.

Construction expansion joints can also be cut with a diamond-tipped saw blade. However, good hands-on finishers can build acceptable joints much cheaper than the cost of sawing, but the overall integrity of the product is weakened by re-handling, time-lapse, but mostly by lack of compacted concrete immediate to both interior faces of a joint. A properly functioning mechanical joint is as important to the roadway as is the curb itself.

SUMMARY OF THE INVENTION

Accordingly, the primary object of the present invention is to provide a simple, yet efficient mechanical joint cutter that will reduce the cost associated with forming expansion joints while maintaining the integrity of the concrete at the joint. The mechanical joint cutter of the present invention operates somewhat like a cross-cut saw. The joint cutter includes a saw blade that is, ideally, shaped to agitate, dislodge, and shove the excess concrete mix out of the cut, as well as smoothing out the two inside opposing faces of the green expansion joint prior to the insertion and reception of a prescribed expansion joint material. Thus, with minimal destruction, this device is believed to reduce the time per expansion joint by fifty percent or more. The current interruption of the contiguousness of the extruded curbing, with associated diminished integrity of the mix is reduced by half or more.

BFIEF DESCRIPTION OF THE DRAWINGS

DETAILED DESCRIPTION OF THE INVENTION

Referring to FIGS. 1 to 4, the joint cutter of the present invention is illustrated. The joint cutter has the following elements.

Figure 1:
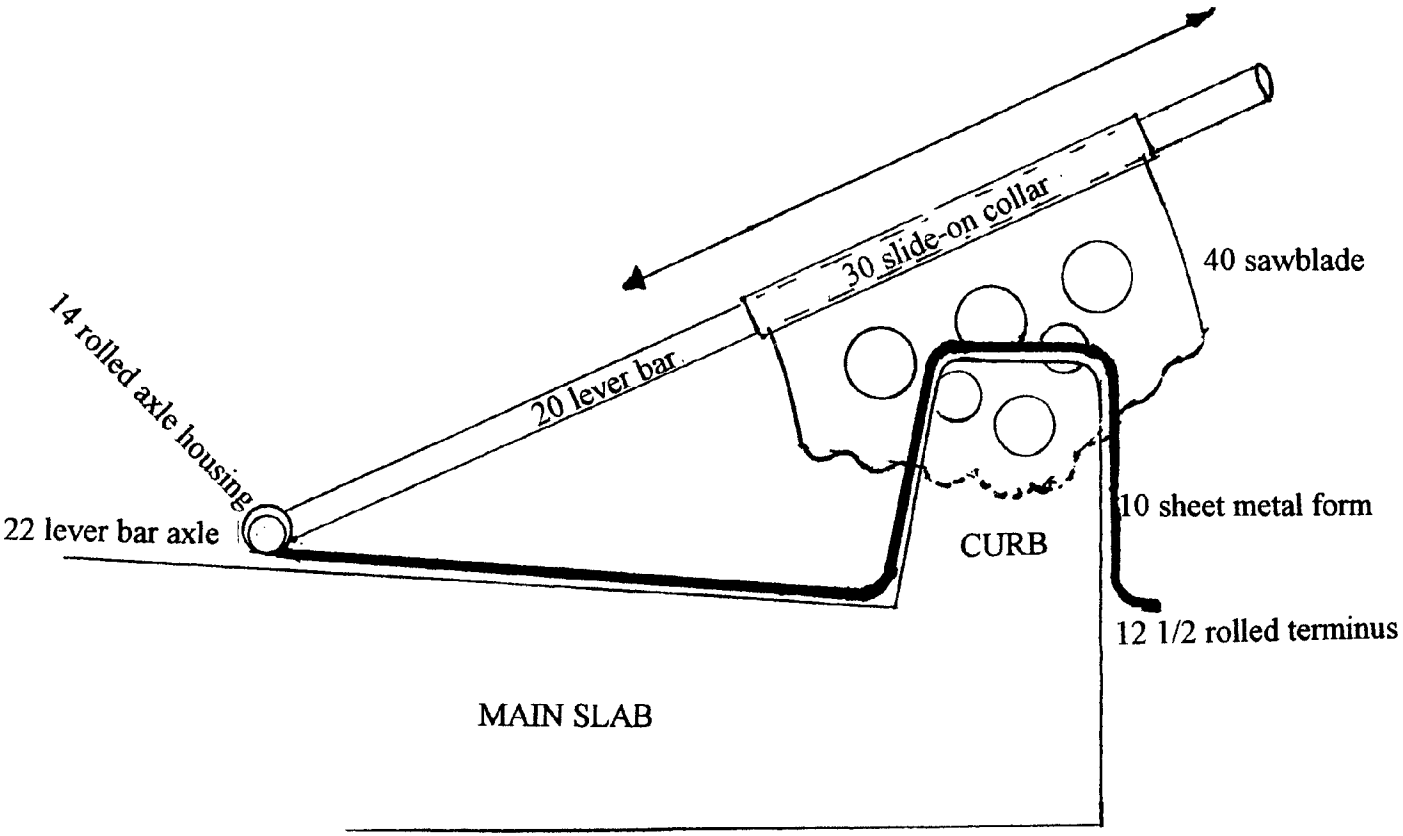
FIG. 1 is a side view of the joint cutter in place, over a curb.

In FIG. 1, a sheet metal form 10, approximately 3/32 inch thick, by 12 inches wide, by 66 inches long, is provided. The sheet metal form 10 has, at a first end, a one-half rolled terminus 12 for the width of the sheet 10, using a two inch diameter to preclude a sharp edge from digging into the wet concrete when setting the sheet metal form 10 over fresh curbing. The form has a vertical portion ascending vertically from terminus 12 for approximately six inches, then turning horizontally for approximately another six inches to provide a horizontal portion, then turning downward, vertically, for approximately another six inches, to provide a second vertical portion, to a point where said second vertical portion meets a second horizontal portion which forms the remainder of the sheet metal form that terminates at a second end that is rolled into a journal axle-housing 14.

Figure 2:
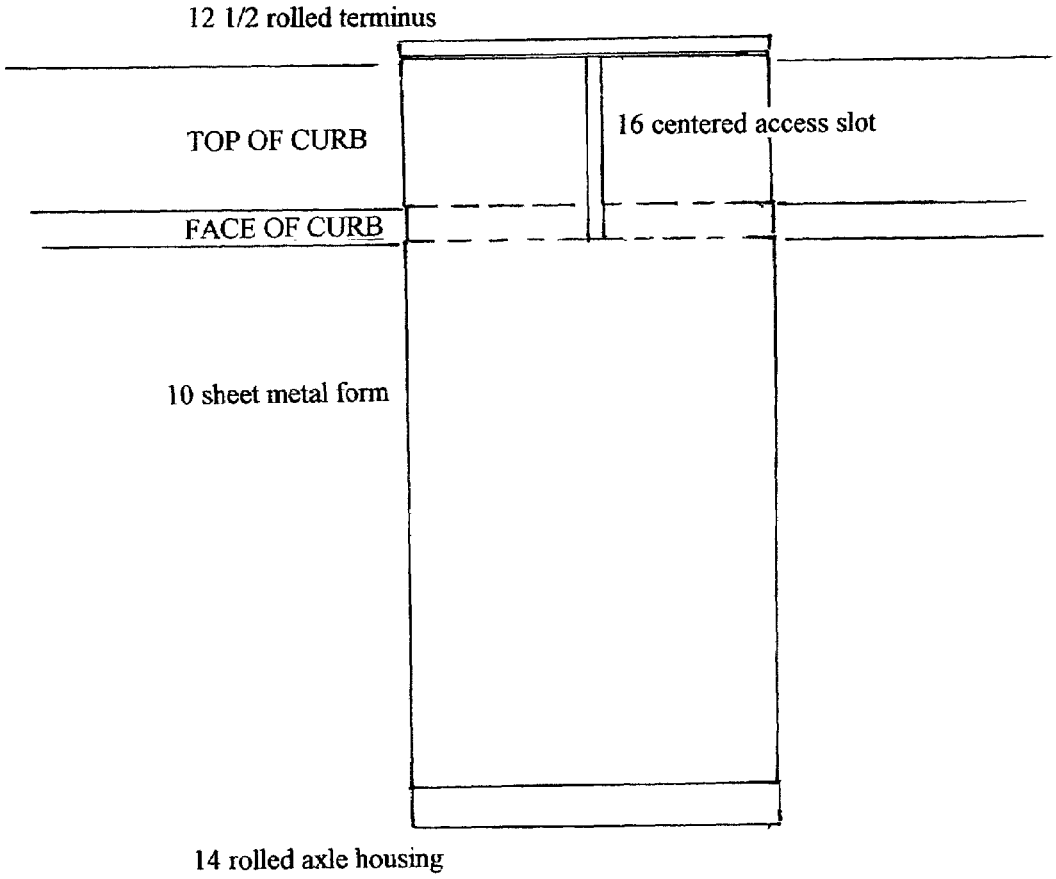
FIG. 2 is a top view of the sheet metal form illustrating the rolled axle housing, the centered access slot, and the rolled terminus.

In FIG. 2, at the intersection of the second vertical portion and the second horizontal portion, a centered 1½ inch access slot 16 passes through the second vertical portion, the first horizontal portion, and the first vertical portion, and terminating in the first vertical portion at a point just above and immediate to the one-half rolled terminus 12. The slot 16 allows access for a saw blade 40 to rout out the unwanted concrete from the cross section of the joint profile while the sheet metal form 10 holds or maintains the specified curb profile.

Figure 3:
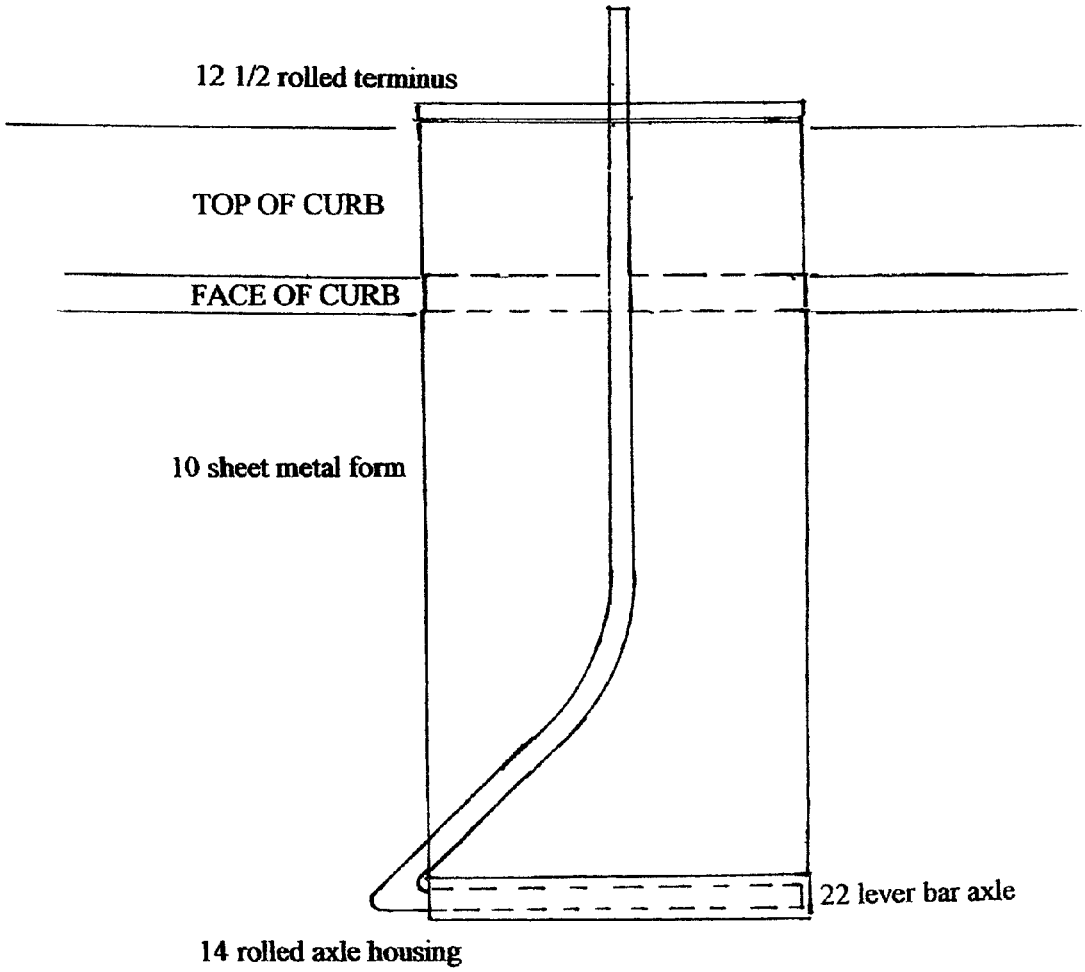
FIG. 3 is a top view of FIG. 2 with the lever bar inserted in the rolled axle housing.

In FIG. 3, a lever bar 20 is provided having a lowermost portion that is bent slightly from a longitudinal axis and then approximately 130 degrees to form the lever bar axle 22, which is inserted into the rolled axle housing 14 of the sheet metal form 10. FIG. 1 demonstrates the assembly and operation of the lever bar 20 with respect to the sheet metal form 10.

Figure 4:
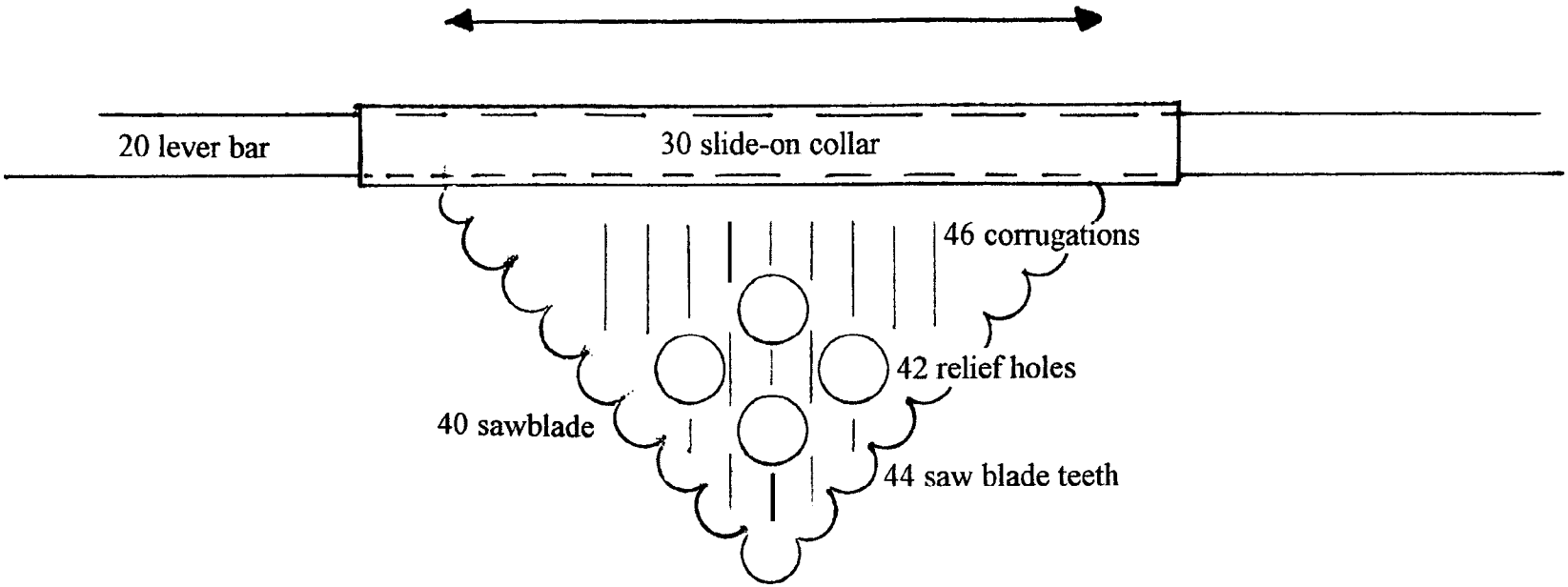
FIG. 4 is a side view of the slide-on collar and the saw blade in place on the lever bar.

In FIG. 4, a complementary, removable and/or replaceable, slide-on collar 30 is further provided. The slide-on collar 30 is sized to slide freely and loosely on the lever bar 20. Attached to the slide-on collar 30 is a specially toothed saw blade 40. The saw blade 40 is designed to etch, or rout out the concrete material where the joint is to be formed in the concrete curbing. The saw blade 40 includes several strategically placed relief holes 42; saw blade teeth 44; and, a plurality of vertical corrugations 46. The relief holes 42 assist with excess concrete removal, and the vertical corrugations 46 serve to smooth the resulting opposing faces of the curbing. The several relief holes 42 in the planar spread of the saw blade allow for the immediately adjacent aggregate to adjust itself by self-shifting. To further facilitate the self-adjustment of that aggregate, the plurality of vertical, outward corrugations 46 on both sides of the saw blade serve to loosen up the mix immediately adjacent to the saw blade, while at the same time, pushing the larger aggregate further into the mix and away from the joint faces, thus smoothing those faces as the curbing is being cut, such that the resulting expansion joint is ready to receive the expansion joint material without further preparation of the joint.

Operation of the invention is now described. The roadway base is prepared, the paving train is spread out and the concrete truck and the curbing machine is extruding fresh, green curbing. As soon as the machine passes, the finisher gently sets the sheet metal form 10 down over the green curbing at the desired joint location. Then the lever bar axle 22 of the lever bar 20 is inserted into the rolled axle housing 14 of the form 10. The slide-on collar 30 with the saw blade 40 attached is slid onto the lever bar 20. Lowering lever bar 20, the saw blade 40 contacts the soft concrete exposed by the slot 16, and grasping the collar 30, the finisher begins a sawing action, i.e. reciprocating the sliding collar 30 back and forth, while simultaneously incorporating the downward leverage provided by the lever bar 20, to cut through the curb. The resulting cut is clear enough to accept insertion of expansion joint material.

The present invention is thus described. It will be obvious that the same may be varied in many ways. It is presumed that motorizing the device would be possible. Such variations are not to be regarded as a departure from the spirit and scope of the present invention, and all such modifications as would be obvious to one skilled in the art are intended to be included within the scope of the following claims.

I claim:

1. A joint cutter for expeditiously cutting through uncured concrete curbing to provide expansion joints in roadway curbing, said joint cutter comprising, in combination, an elongate form to be placed on said uncured concrete and having a proximal end adapted for engagement with said curb and a distal end having a journal axle housing, a lever bar, said lever bar having an axle at one end that is received in said axle housing, a slide-on collar, and a saw blade attached to said slide-on collar, said lever bar accepting said slide-on collar at an end opposite said axle, for reversible linear movement.

2. The joint cutter of claim 1, wherein said saw blade includes several strategically placed relief holes and a plurality of vertical concrete smoothing corrugations.

3. The joint cutter of claim 1, wherein said proximal end of said elongate form, has a one-half rolled terminus across a width thereof, a first vertical portion ascending vertically from said terminus, then turns horizontally to provide a first horizontal portion, then turning downward, vertically to provide a second vertical portion, to a point wherein said second vertical portion meets a second horizontal portion which terminates at said distal end.

4. The joint cutter of claim 3, wherein an access slot passes through said second vertical portion, said first horizontal portion, and said first vertical portion, and terminating in said first vertical portion at a point just above and immediate to said one-half rolled terminus.

5. The joint cutter of claim 4, wherein said lever bar is positioned such that said saw blade passes through said access slot.

6. The joint cutter of claim 5, wherein said saw blade includes several strategically placed relief holes and a plurality of vertical concrete smoothing corrugations.

7. The joint cutter of claim 4, wherein said access slot is centered relative to the width of the elongate form.

8. The joint cutter of claim 7, wherein said lever bar is positioned such that said lever bar is centered relative to the width of said elongate form such that said saw blade passes through said access slot.

9. The joint cutter of claim 8, wherein said saw blade includes several strategically placed relief holes and a plurality of vertical concrete smoothing corrugations.

* * * * *